US009065257B2

(12) United States Patent
Ichihara et al.

(10) Patent No.: US 9,065,257 B2
(45) Date of Patent: Jun. 23, 2015

(54) METHOD OF MANUFACTURING ELECTRODE COMPLEX FOR FORMING ELECTRODE OF SPARK PLUG, AND METHOD OF MANUFACTURING SPARK PLUG

(75) Inventors: Hiroshi Ichihara, Aichi (JP); Ryuji Emoto, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 338 days.

(21) Appl. No.: 13/819,001

(22) PCT Filed: Sep. 20, 2011

(86) PCT No.: PCT/JP2011/071344

§ 371 (c)(1), (2), (4) Date: Feb. 26, 2013

(87) PCT Pub. No.: WO2012/039381

PCT Pub. Date: Mar. 29, 2012

(65) Prior Publication Data

US 2013/0157538 A1 Jun. 20, 2013

(30) Foreign Application Priority Data

Sep. 24, 2010 (JP) ..... 2010-214186

(51) Int. Cl.

| | |
|---|---|
| ***H01T 21/02*** | (2006.01) |
| ***H01T 13/32*** | (2006.01) |
| ***H01T 21/06*** | (2006.01) |

(52) U.S. Cl.
CPC ..... *H01T 21/02* (2013.01); *H01T 13/32* (2013.01); *H01T 21/06* (2013.01)

(58) Field of Classification Search
CPC ..... H01T 21/02
See application file for complete search history.

(56) References Cited

U.S. PATENT DOCUMENTS

| | | | | |
|---|---|---|---|---|
| 2002/0092835 | A1 | 7/2002 | Uehara | B23K 26/00 |
| 2004/0029480 | A1 * | 2/2004 | Fujita et al. | 445/7 |
| 2010/0242888 | A1 | 9/2010 | Torii et al. | 123/169 |

FOREIGN PATENT DOCUMENTS

| | | | |
|---|---|---|---|
| JP | 6-292987 | 10/1994 | B23K 26/02 |
| JP | 2002-216930 | 8/2002 | H01T 21/02 |
| JP | 2002-267431 | 9/2002 | G01B 11/26 |
| JP | 2004-134209 | 4/2004 | H01T 13/20 |
| JP | 2009-158408 | 7/2009 | H01T 13/20 |
| WO | WO 2009/063930 | 5/2009 | H01T 13/20 |

OTHER PUBLICATIONS

Form PCT/ISA/210—Int'l Search Report (from corresponding Int'l Patent App. No. PCT/JP2011/071344-English version only); 2 pages.

* cited by examiner

*Primary Examiner* — Mary Ellen Bowman
(74) *Attorney, Agent, or Firm* — Kusner & Jaffe

(57) ABSTRACT

A method of manufacturing an electrode composite for forming an electrode of a spark plug, the electrode composite being formed by laser-welding a first electrode member and a second electrode member together.

5 Claims, 13 Drawing Sheets

METHOD OF MANUFACTURING ELECTRODE COMPLEX FOR FORMING ELECTRODE OF SPARK PLUG, AND METHOD OF MANUFACTURING SPARK PLUG

FIELD OF THE INVENTION

The present invention relates to a spark plug used for providing ignition in an engine, and more particularly to a method of manufacturing an electrode composite used to form an electrode of the spark plug, the electrode composite being formed by welding a first electrode member and a second electrode member together, and to a method of manufacturing a spark plug.

BACKGROUND OF THE INVENTION

In some spark plugs, in order to enhance ignition performance, a noble metal tip of platinum, iridium, or the like is fixed by welding to the end of a center electrode or a ground electrode located on a side toward a spark gap. Recently, in order to reduce costs of the electrodes, strong demand has arisen to reduce the diameter and size of a noble metal tip. In order to implement a reduction in diameter and size of the noble metal tip, welding the noble metal tip directly to an electrode is not efficient. Thus, there is known a spark plug configured as follows. Japanese Patent Application Laid-Open (kokai) No. 2004-134209 and Japanese Patent Application Laid-Open (kokai) No. 2009-158408 discloses a spark plug, wherein, in place of a sole noble metal tip, there is provided a tip body (hereinafter, may be referred to as the first tip) 11, which corresponds to a first electrode member and is formed from Ni, etc., and a noble metal tip (hereinafter, may be referred to as the second tip) 21, which corresponds to a second electrode member and is formed separately in a size smaller than conventionally known, as illustrated in FIG. 10A. As shown in FIG. 10B, the tip body 11 and the noble metal tip 21 are positioned and welded together into a composite tip 31, which corresponds to an electrode composite. The composite tip 31 is welded via the tip body 11 to, for example, a ground electrode body formed at the forward end of a metallic shell of the spark plug (or welded to a center electrode body).

FIG. 11 shows an example of such a spark plug 41. The spark plug 41 has an insulator 43. A center electrode 71 is disposed in a forward end portion of an axial bore of the insulator 43, and a metallic shell 51 surrounds the insulator 43. A ground electrode 61 has one end joined to a forward end 52 of the metallic shell 51 and another end facing the forward end of the center electrode 71. The ground electrode 61 is configured such that the composite tip 31, which is formed by joining the first tip 11 and the second tip 21 together, is joined to a ground electrode body 60.

The noble metal tip (the second tip) 21 assumes the form of a very small circular columnar shape having an outside diameter of 1 mm or less (e.g., about 0.7 mm to 0.8 mm) and a height of about 0.5 mm. The joining surface of the mate tip body (the first tip) 11 to which an end surface 23 of the second tip 21 is to be welded; i.e., an end surface (a distal end surface) 13 of the tip body 11, also has a very small outside diameter of about 0.8 mm. A portion 15 of the mate first tip 11, that is to be joined to an electrode (the center electrode or the ground electrode), has a relatively large outside diameter. Accordingly, as shown in FIG. 10, the first tip usually has a concentrically stepped circular columnar structure having different diameters such that the base portion 15 having an end surface 12 to be joined to an electrode (the center electrode or the ground electrode) has a large diameter, whereas the end surface (the distal end surface) 13 to which the second tip 21 is to be welded has a small diameter.

Meanwhile, the end surface 23 of the second tip 21 is welded to the small-diameter distal end surface (the end surface) 13 of the first tip 11 conventionally in the following manner. For example, as shown in FIG. 10, while the first tip 11 is held by a chuck 81, the second tip 21 is positioned and disposed on and then welded to the first tip 11. In this case, the first tip 11 is held by chucking the outer circumferential surface of the large-diameter base portion 15 of the first tip 11. The end surface 23 of the second tip 21 is then concentrically positioned and placed on the end surface 13 of a small-diameter circular columnar portion 17 of the chucked first tip 11. The other end surface of the second tip 21 is pressed with a press pin (not shown). Under the pressed condition, the chuck 81 is rotated about its center axis C1, and the end surfaces to be joined of the two tips 11 and 21 are circumferentially laser-welded along their outer circumferences.

A collet chuck mechanism having a plurality of chuck claws (hereinafter, may be referred to merely as claws) 83 is usually used in the chuck 81. As shown in FIG. 12, the chuck 81 has the following configuration: when a single cylinder (not shown) is driven, claws 83 which are disposed orthogonal to a rod of the cylinder and, as viewed from the axial direction of the rod, usually at equal angular intervals (divided evenly into thirds) simultaneously move forward at the same speed in respective closing directions, thereby clamping the first tip 11. Thus, theoretically, the first tip 11 is fixed concentric with a reference center (reference center axis) C1 of a chuck surface 82.

However, when the first tip 11 is held, i.e., chucked, within the chuck 81, as exaggeratedly represented with the solid lines in FIG. 12, the first tip 11 is fixed in such a condition as to involve a positional deviation (eccentric error) Z, which is in many cases a very small amount, from a position concentric with the reference center (the reference center axis of the chuck) C1 of the chuck surface 82, as represented with the dashed circles in FIG. 12. That is, as shown in FIG. 12, the first tip 11 is fixed such that an actual center axis (may be called the center) C2 of the first tip 11 is eccentric to the reference center axis C1 of the chuck 81. This is for the following reason: regardless of a collet chuck, in a chuck having a plurality of claws, in view of the mechanism thereof, it is impossible to move the claws forward 100% simultaneously at the same speed over the same stroke in units of several-μm. Therefore, holding the first tip 11 with the chuck 81 involves a problem that, at a minimum, produces a positional deviation Z of about 0.025 mm from the reference center axis C1 of the chuck on one side.

Meanwhile, as shown in FIG. 13, when the second tip 21 is supplied and disposed in relation to the first tip 11 chucked under the condition that such a positional deviation Z is involved, since the preset reference center axis C1 of the chuck 81 is fixed, by means of controlling disposition of the second tip 21 with respect to the center axis C1, the positional error of the center axis of the second tip 21 with respect to the reference center axis C1 of the chuck 81 can be restrained to a negligibly small level (an error on the order of about 0.005 mm) as compared with an unavoidable error peculiar to the chuck mechanism. That is, by use of a supply means which employs a servomechanism or the like, the second tip 21 can be disposed with involvement of substantially no error; i.e., with high accuracy, with respect to the reference center axis C1 of the chuck 81. Therefore, in view of an error peculiar to the chuck mechanism which unavoidably arises at the time of chucking the first tip, a conventional manufacturing method needs to employ an eccentric error Z of at least about ±0.025 mm on one side as tolerance for the center runout (coaxiality) of the second tip in relation to the first tip.

In this regard, in order to improve performance of a spark plug, demand for improvement of dimensional accuracy associated with welding of the second tip to the first tip is becoming stronger and stronger. Specifically, a currently required tolerance on coaxiality (eccentric error) between the first and second tips is about 0.01 mm to 0.015 mm on one side. Thus, for a method in which the first tip is fixed with the above-mentioned chuck or the like, and the second tip is supplied and welded to the fixed first tip, difficulty is encountered in satisfying such a severe tolerance requirement for coaxial accuracy.

According to conceivable measures to overcome the above problem, after the second tip is supplied and disposed on the first tip held by a chuck, coaxiality (eccentricity) between the first and second tips is measured or detected through image processing or the like, and positional correction is performed for example, by shifting, according to the measured eccentricity (error), the second tip so as to be aligned with the center axis of the first tip. However, since such positional correction is performed after the second tip is supplied and disposed on the first tip, the end surfaces of the tips in contact with each other rub against each other, potentially resulting in the occurrence of a defect, such as scratches, on the end surfaces. Also, since the positional correction is performed after the second tip is supplied and disposed on the first tip, the number of steps increases. As a result, the efficiency in manufacturing a composite tip may drop, and in turn, spark plug productivity may drop. Furthermore, when, subsequent to the positional correction in which the second tip is positionally shifted so as to be coaxial with the first tip held by the chuck, welding is performed on the outer circumferential edges of the joining surfaces of the tips while the chuck is rotated, the center of rotation of the chuck is the reference center axis C1 of the chuck, whereas the actual center axes of the tips deviate by an error from the reference center axis C1. Thus, there also arises a problem that the distance between a laser welding apparatus and a region to be welded (laser radiation distance) varies with rotation of the chuck.

The above-mentioned problem is not limited to the case of manufacturing the composite tip, which corresponds to an electrode composite, formed by welding together the first tip (the tip body), which corresponds to the first electrode member, and the second tip (the noble metal tip), which corresponds to the second electrode member. In the spark plug 41 shown in FIG. 11, the center electrode 71 assumes the form of an electrode composite composed of a center electrode body 70, which corresponds to the first electrode member, and an electrode tip 77, which is welded to the forward end of the center electrode body 70 and corresponds to the second electrode member. Manufacturing the center electrode 71 in the form of such an electrode composite also involves the above-mentioned problem, for the following reason: even in manufacture of the center electrode 71, by use of an apparatus similar to that mentioned above, the center electrode body 70 is chucked; the electrode tip 77 is supplied and then positioned and disposed on the forward end of the center electrode body 70; and steps similar to those mentioned above are carried out. That is, manufacturing not only the above-mentioned composite tip 31 and the center electrode 71, but also an electrode composite formed through welding of the first electrode member and the second electrode member and adapted to form an electrode of a spark plug has involved a similar problem for a reason similar to that mentioned above.

SUMMARY OF THE INVENTION

The present invention has been conceived in view of the above problem. An advantage of the present invention is a method of efficiently manufacturing an electrode composite for forming an electrode of a spark plug, such as a composite tip formed by efficiently disposing a noble metal tip (a second tip), which corresponds to a second electrode member, on a first tip (a tip body), which corresponds to a first electrode member, with high coaxial accuracy so as to prepare for welding, and then welding the tips together, without involvement of a drop in manufacturing efficiency and the occurrence of a defect, such as scratches, as well as a method of manufacturing a spark plug.

In accordance with the present invention, there is provided a method of manufacturing an electrode composite for forming an electrode of a spark plug, the electrode composite being formed by laser-welding a first electrode member and a second electrode member together, the method comprising:

a first electrode member holding step of holding the first electrode member by a chuck of a chuck unit;

a second electrode member supply step of supplying the second electrode member such that an end surface of the second electrode member comes into contact with an end surface of the first electrode member; and a laser welding step of welding outer circumferential edges of the end surfaces through which the first electrode member and the second electrode member are in contact with each other;

the method being characterized by further comprising:

an eccentric error detection step coming after the first electrode member holding step and before the second electrode member supply step and adapted to detect an eccentric error between a position of an actual center axis of the first electrode member and a shaft of a base rotatably supporting the chuck of the chuck unit, and a center axis position correction step of correcting the position of the actual center axis of the first electrode member when the eccentric error detected in the eccentric error detection step falls outside a tolerance range subsequent to the eccentric error detection step, so as to align the actual center axis of the first electrode member with an axis of the shaft of the base.

In accordance with another aspect of the present invention, there is provided a method of manufacturing an electrode composite for forming an electrode of a spark plug, as described above, characterized by further comprising a temporary welding step coming after the second electrode member supply step and before the laser welding step and adapted to temporarily weld the outer circumferential edges of the end surfaces through which the first electrode member and the second electrode member are in contact with each other.

In accordance with another aspect of the present invention, there is provided a method of manufacturing an electrode composite for forming an electrode of a spark plug, as described above, characterized in that:

a plurality of the chuck units are disposed on revolvingly moving means so as to sequentially move in association with revolution of the revolvingly moving means, and the eccentric error detection step and the center axis position correction step are performed at the same position in the course of revolution.

In accordance with still another aspect of the present invention, there is provided a method of manufacturing an electrode composite for forming an electrode of a spark plug as described above, characterized in that:

a plurality of the chuck units are disposed on revolvingly moving means so as to sequentially move in association with revolution of the revolvingly moving means, and the first electrode member holding step and the eccentric error detection step are performed at different positions in the course of revolution.

In accordance with another aspect of the present invention, there is provided a method of manufacturing a spark plug which has an insulator having an axial bore in a direction of an axis, a center electrode disposed in a forward end portion of the axial bore, a metallic shell circumferentially surrounding the insulator, and a ground electrode whose one end is joined to the metallic shell and whose other end faces a forward end of the center electrode, and in which the center electrode or the ground electrode is an electrode composite formed by joining a first electrode member and a second electrode member together, or is formed by joining the electrode composite, the method being characterized in that the electrode composite is manufactured by a manufacturing method described above.

According to the present invention, even though, when the first electrode member (e.g., a first tip; hereinafter, may be referred to as the first tip) is held by the chuck, the actual center axis of the first tip involves an eccentric error with respect to the reference center axis of the chuck; i.e., the shaft of the base (the shaft of the chuck unit) rotatably supporting the chuck of the chuck unit, and the eccentric error falls outside a tolerance range, before the second electrode member (e.g., a second tip; hereinafter, may be referred to as the second tip) is supplied and then positioned and disposed on the first tip, the position of the actual center axis of the first tip is corrected so as to be aligned with the axis (the position of the axis) of the shaft of the base of the chuck unit. Therefore, the thus-corrected position of the first tip coincides with the position of the shaft without involvement of an error associated with chucking. Thus, when the second tip is supplied and then positioned and disposed on the first tip located at such a position, the first and second tips can be readily disposed with highly accurate coaxiality. Subsequently, when the first and second tips are welded while the chuck unit is rotated about the axis of the shaft, since the center axes of the first and second tips maintain high coaxiality with the shaft, an electrode composite having high coaxial accuracy can be yielded efficiently.

Also, the present invention does not employ an aligning method, wherein the coaxiality (eccentric error) of the second tip with respect to the first tip is adjusted. If after the second tip is supplied and then positioned and disposed on the first tip held by the chuck, coaxiality between the first and second tips is measured, and the measured coaxiality involves an error which falls outside tolerance. Therefore, joining surfaces (the end surfaces of the first and second tips in contact with each other) do not rub each other and thus are free from scratching. Notably, as in the case of the invention described above, addition of the temporary welding step improves the efficiency of a regular welding step.

As described above, the eccentric error detection step and the center axis position correction step may be performed at the same position in the course of revolution. Also, as described above, preferably, the first electrode member holding step and the eccentric error detection step are performed at different positions in the course of revolution. Specifically, after the first electrode member; for example, the first tip, is supplied and held, the revolvingly moving means is driven to move by a predetermined amount the chuck unit which holds the first tip. At a position where the chuck unit stops; i.e., at a position different from the first tip supply position, the position of the actual center axis of the first tip held by the chuck unit is measured by image processing, and an eccentric error between the position of the actual center axis of the first tip and the shaft of the chuck unit is detected. In this manner, by means of performing these steps at different positions rather than at one position, working time at the individual steps can be reduced, whereby efficiency in manufacture of the electrode composite (e.g., a composite tip) can be enhanced. As described above, according to the present invention, the second electrode member can be joined to the first electrode member without involvement of a deterioration in coaxiality and scratching on the joining surfaces, whereby a highly accurate electrode composite can be efficiently manufactured.

BRIEF DESCRIPTION OF THE DRAWINGS

FIGS. 10A and 10B are a pair of views for explaining the configuration of a composite tip, wherein FIG. 10A is for explaining component tips before welding, and FIG. 10B is for explaining the composite tip after welding.

DETAILED DESCRIPTION OF PREFERRED EMBODIMENTS

Figure 10A:
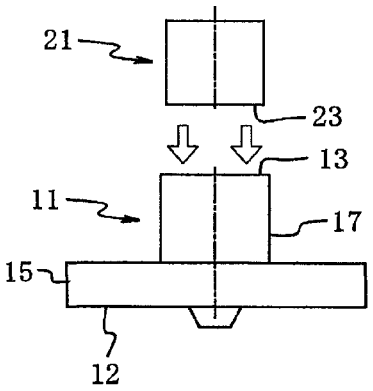

Referring now to the drawings wherein the showings are for the purpose of illustrating a preferred embodiment of the invention only, and not for the purpose of limiting the same, a manufacturing method according to an embodiment of the present invention will be described in detail. First, an electrode composite to be manufactured in the present embodiment will be described. The electrode composite to be manufactured in the present embodiment is a composite tip 31 shown in FIG. 10B. As shown in FIG. 10A, a first electrode member and a second electrode member which constitute the composite tip 31 are a first tip 11 and a second tip 21, respectively. The composite tip 31 is described below in detail. The first tip (a tip body made of nickel) 11 of the composite tip 31 includes a disklike base portion 15 and a circular columnar portion 17 having a diameter (e.g., an outside diameter of 0.78 mm) smaller than that of the base portion 15 and concentrically protruding from the upper end surface of the base portion 15 in FIGS. 10A and 10B and thus have a shape resembling an inverted letter T. The first tip 11 also has a very small protrusion 19 having the shape of a truncated cone and concentrically protruding from an end surface (a bottom surface) 12 of the base portion 15 located on the opposite side (the lower side in FIGS. 10A and 10B). The second tip (a tip made of a noble metal (e.g., Pt)) 21 is similar to that shown in FIG. 10 and has a circular columnar shape having a diameter (an outside diameter of 0.75 mm) slightly smaller than that of the circular columnar portion 17 of the first tip 11.

Figure 10B:
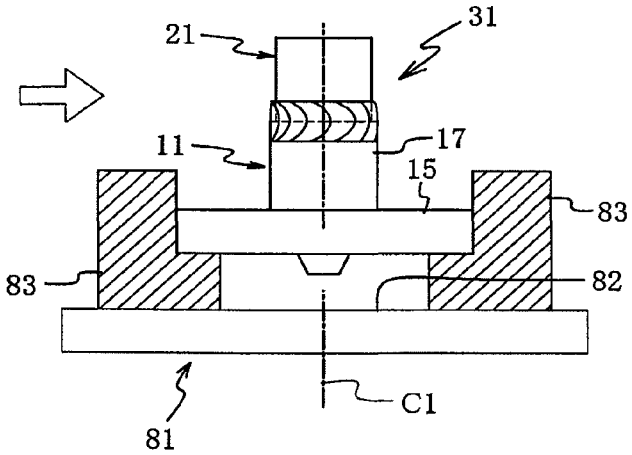
Figure 11:
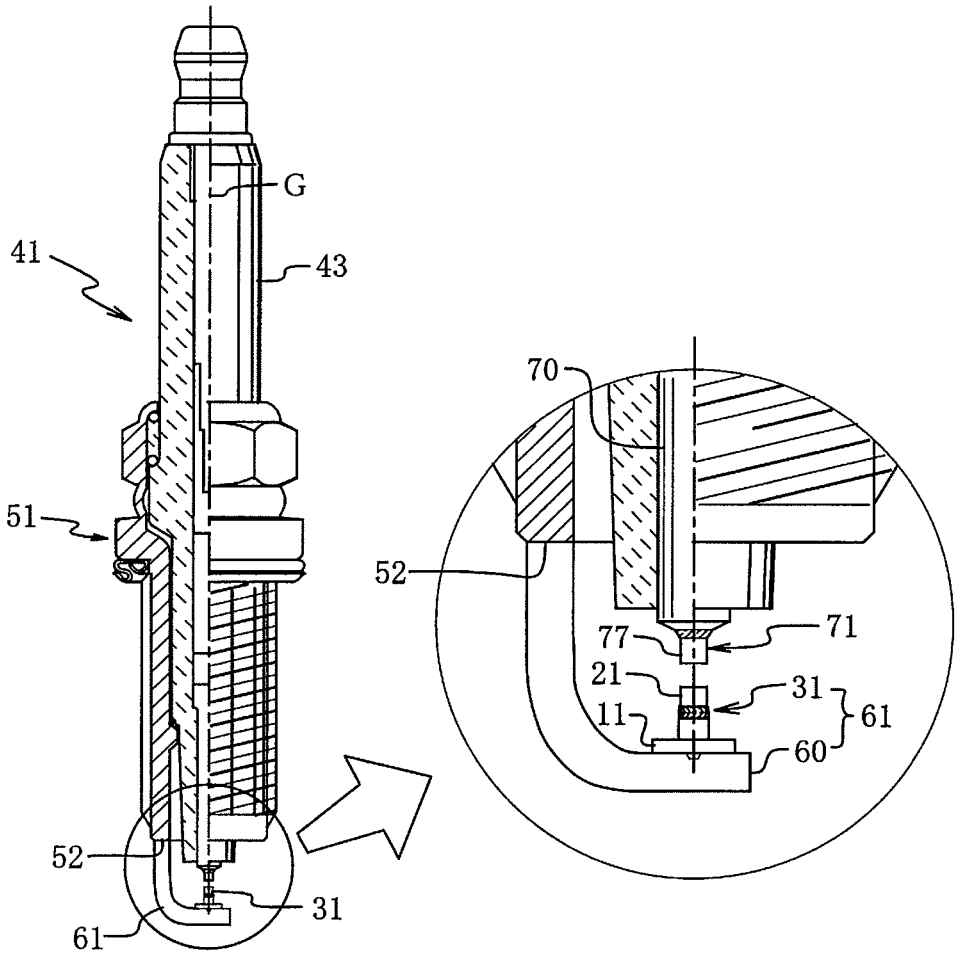
FIG. 11 is an explanatory view showing a spark plug using the composite tip.
Figure 12:
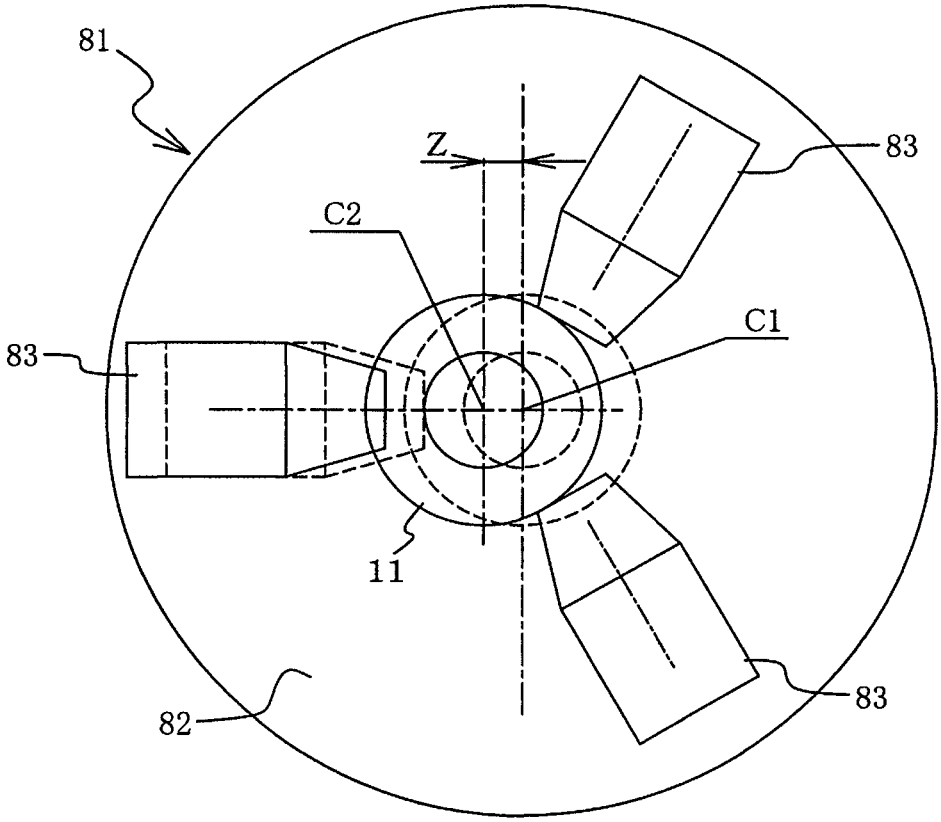
FIG. 12 is an explanatory view for eccentric error which arises in fixing a first tip by a chuck.
Figure 13:
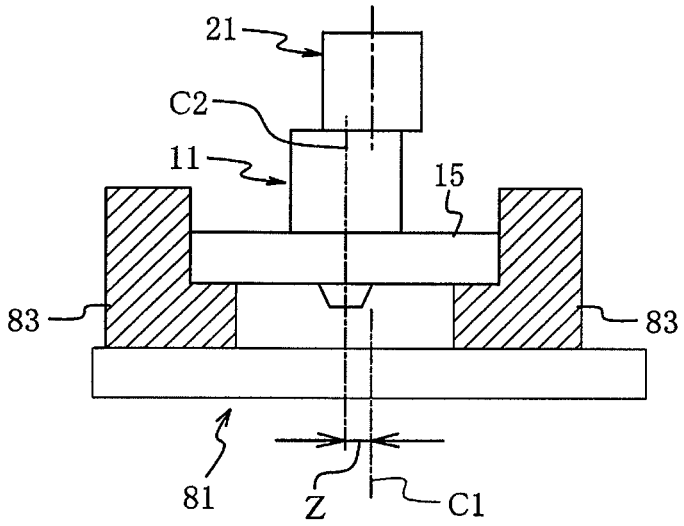
FIG. 13 is an explanatory view showing disposition of a second tip on the first tip which involves eccentric error.

As shown in FIG. 10B, the composite tip 31 is formed as follows: the second tip 21, which will be located on a side toward a spark gap, is supplied to a position above an end surface 13 of circular columnar portion 17 (a small-diameter portion) of the first tip 11 and then positioned and disposed on the end surface 13 of the first tip 11 such that an end surface 23 of the second tip 21 is concentric with the end surface 13 of the first tip 11, and the outer circumferential edges of the end surfaces 13 and 23 through which the first and second tips 11 and 21 are in contact with each other are laser-welded along a circumferential direction. As shown in FIG. 11, in the present embodiment, the composite tip 31 is subsequently welded to a ground electrode body (or a center electrode) 61 welded to a forward end 52 of a metallic shell 51 for a spark plug, thereby configuring a spark plug 41. In the present embodiment, allowable coaxiality (allowable eccentric error) is, for example, a very small amount of 0.015 mm on one side; i.e., tolerance for eccentric error is determined such that the second tip 21 does not protrude radially outward from the small-diameter circular columnar portion 17 of the first tip 11.

Figure 1:
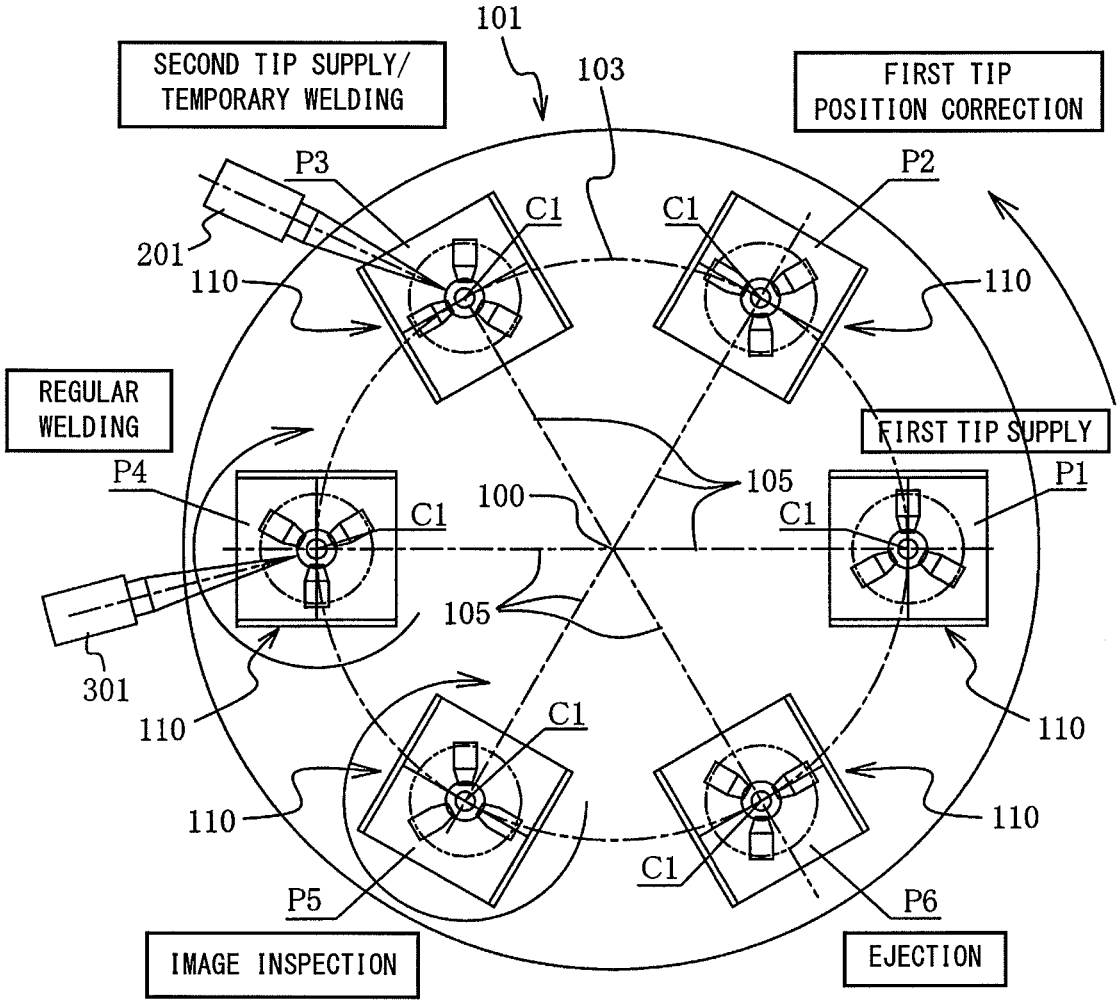
FIG. 1 is a schematic configurational view showing a circular table, on which chuck units are disposed, of a manufacturing apparatus used in a manufacturing method of the present invention, as viewed from above the circular table.

Next, means (a manufacturing apparatus) used in the manufacturing method of the present embodiment for manufacturing the composite tip 31 by welding will be described in detail with reference to FIG. 1, etc. In FIG. 1, reference numeral 101 denotes a circular table, which serves as revolvingly moving means for revolvingly moving a plurality of similar chuck units 110, which will be next described, in a simultaneous manner. FIG. 1 is a schematic configurational view showing the circular table 101 on which the chuck units 110 are disposed, as viewed from above the circular table 101. The circular table is configured to be intermittently restated about its center by an unillustrated rotational drive means such that the circular table rotates by 60 degrees and stops in a repeated manner. In the present embodiment, the chuck units 110 of the same configuration are disposed and mounted with high dimensional accuracy on an imaginary circle 103 whose center coincides with a center 100 of the circular table 101. The chuck units are mounted at six positions coinciding with intersections of the imaginary circle 103 and straight lines 105 which divide the imaginary circle 103 into six equal parts (intersections of the imaginary circle 103 and radial lines 105 drawn radially from the center 100 of the circular table 101 at equal angular intervals of 60 degrees), the intersections serving as centers C1 of the chuck units 110. Thus, when the circular table 101 rotates by 60 degrees, the chuck units 110 move (in the present embodiment, rotate (revolve) counterclockwise in FIG. 1) accordingly along the imaginary circle 103. As will be described later in detail, the chuck units 110 are disposed on the circular table 101 in such a manner as to be rotatable about their centers C1 coinciding with the intersections of the imaginary circle 103 and the radial lines 105 which divide the imaginary circle 103 into six equal parts. FIG. 1 shows a state in which the circular table 101 is not rotating (at a rest).

Figure 2:
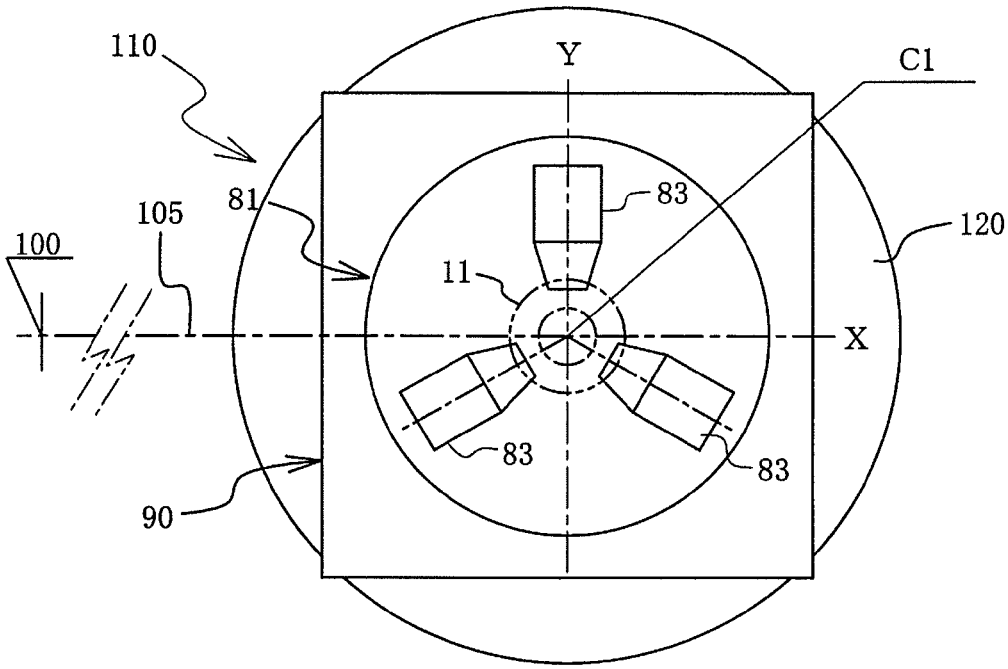
FIG. 2 is an enlarged explanatory view showing the chuck unit at the start position of a manufacturing process, as viewed from above the chuck unit.
Figure 3:
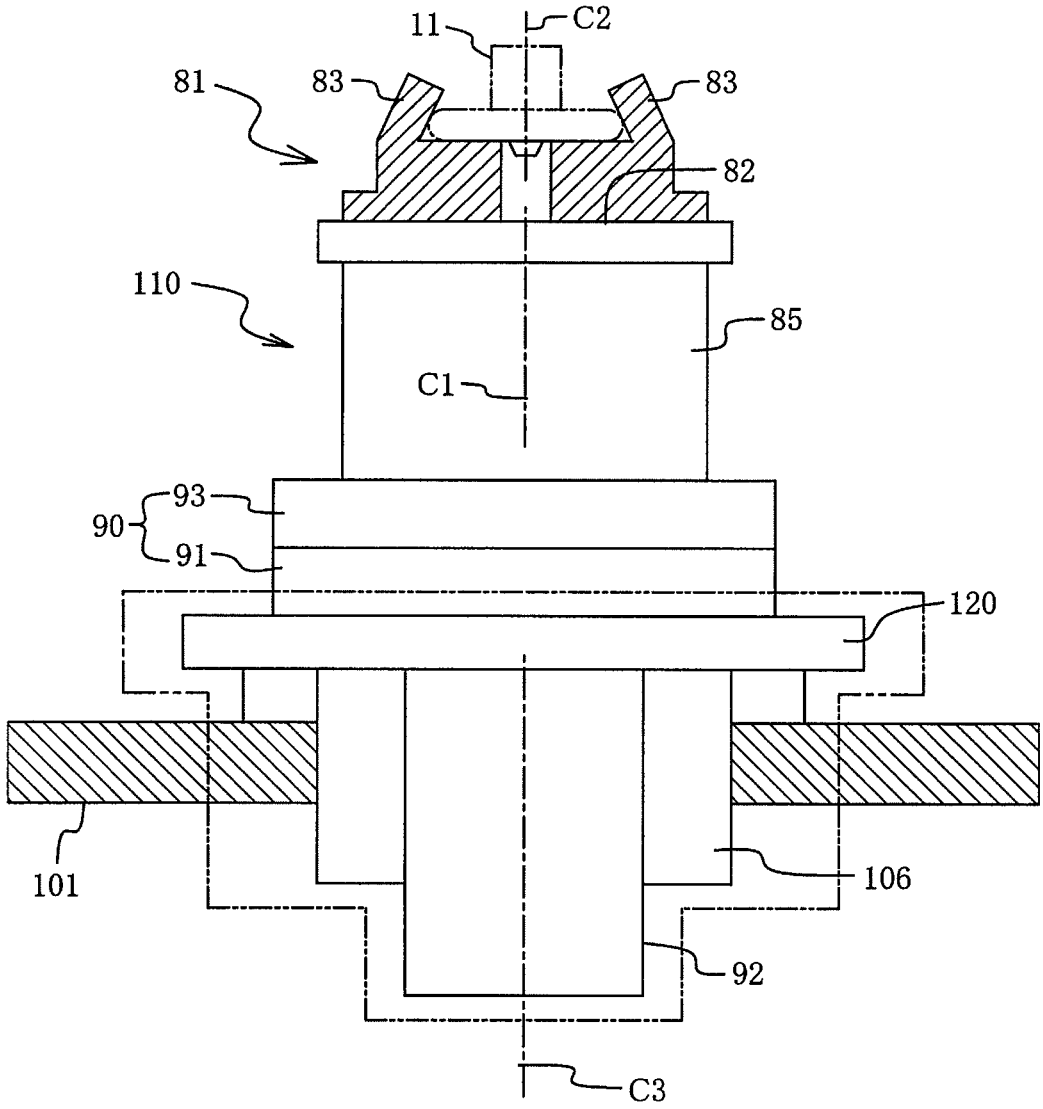
FIG. 3 is an enlarged elevational view for explaining the chuck unit of FIG. 2.

Next, the chuck units 110 disposed on the circular table 101 will be described with reference to FIGS. 2 and 3. Each of the chuck units 110 has, at its top, a chuck 81 of a collet chuck 81 type having a plurality of (in the present embodiment, three) chuck claws 83 which can hold the outer circumference of the base portion 15 of the first tip 11. The chuck 81 has a chuck pedestal 85 at its lower portion, and the chuck pedestal 85 contains an unillustrated chuck drive means (such as an air cylinder) for opening and closing the chuck 81. The chuck 81 is configured to encompass the chuck pedestal 85. The chuck pedestal 85 which encompasses the chuck 81 is disposed on a conventionally known chuck position adjustment means 90 which can adjust the position of the reference center axis C1 of the chuck 81 in two orthogonal directions (X and Y directions) as viewed in plane. The chuck position adjustment means 90 includes a lateral slide member (table) 91 which slides on a base 120 along a guide, for example, in the X direction as viewed in plane; a longitudinal slide member 93 which slides on the lateral slide member (table) 91 along a guide in the Y direction orthogonal to the X direction as viewed in plane; and a servomechanism (not shown) for driving the lateral and longitudinal slide members 91 and 93 in the X and Y directions, respectively. The chuck pedestal 85 is fixedly supported on the longitudinal slide member 93 of the chuck position adjustment means 90. The bases 120, which support the respective chuck position adjustment means 90, are disposed on the circular table 101 such that shafts 92 provided at their bottoms are supported by respective bearings 106. The bearings 106 are disposed with high accuracy such that their centers coincide with the intersections of the above-mentioned imaginary circle 103 of the circular table 101 and the radial lines 105 drawn at 60-degree intervals. The shafts 92 are rotated by respective chuck unit rotational-drive means (not shown). By means of rotationally driving the shafts 92, the respective chuck units 110 are rotated on the circular table 101. The reference center axis C1 of each of the chucks 81 is held coaxially with an axis C3 of the corresponding shaft 92 (the chuck 81 and the shaft 92 share the same axis) and serves as a design reference position.

As mentioned above, in the present embodiment, by means of the shaft 92 being rotated in relation to the circular table 101, the base 120 integral with the shaft 92, the chuck position adjustment means 90 provided on the base 120, and the chuck unit 110 encompassing the chuck 81 and provided on the chuck position adjustment means 90 can be rotated via rotational drive means (not shown). Also, the shaft 92 and the reference center axis C1 of the chuck 81 become coaxial with each other when the chuck position adjustment means 90 is situated at the reference position. Thus, when, under the condition that the chuck position adjustment means 90 is situated at the reference position, the shaft 92 is rotated in relation to the circular table 101, the chuck 81 is rotated about the reference center axis C1 aligned with the axis (centerline) of the shaft 92. In the present embodiment, the shaft 92 is rotated when the circular table 101 is at halters, i.e., stationary, in the course of revolution (in the course of rotation).

Next will be described a process of manufacturing the composite tip 31, which corresponds to the electrode composite, in the present embodiment by intermittently rotating the above-mentioned circular table 101. The following description assumes that, in the present embodiment, the far right position in FIG. 1 is a position at which the first tip 11, which corresponds to the first electrode member, is supplied and disposed; i.e., a start position (first position) P1 of the process. First, the entire process will be briefly described. The circular table 101 is rotationally driven and then stopped. First tip supply means (first electrode member supply means, not shown) supplies the first tip 11 to the chuck 81 of the chuck unit 110, which is at the start position, and disposes the first tip 11 from above the chuck 81 such that the base portion 15 of the first tip 11 faces a chuck surface 82; and the chuck 81 holds (chucks) the first tip 11. Then, the circular table 101 is rotated (counterclockwise) by 60 degrees and then stopped. By repeating this operation, the chuck unit 110 is transmitted sequentially from a second position P2 to a sixth position P6 along a circular path (the circumference of the imaginary circle 103) and undergoes the following steps at individual stop positions. At the second position P2 and subsequent positions (stop positions), the following steps are performed sequentially: positional correction of the first tip 11; supply and temporary welding of the second tip 21, which corresponds to the second electrode member; regular welding of the first tip 11 and the second tip 21; image inspection of welded condition, etc.; and ejection (delivery) of the composite tip 31, which corresponds to the electrode composite formed by welding. These steps will be sequentially described below, starting from the step at the start position (first position) P1.

At the start position (first position) P1, the first tip 11 is supplied to the chuck 81, which is in an opened condition. Then, a first tip holding step (hereinafter, may be referred to as the first tip holding step), which corresponds to a first electrode member holding step, is performed; specifically, as mentioned above, the claws 83 of the chuck 81 are driven so as to chuck and hold the outer circumferential surface of the base portion 15 of the first tip 11. The chuck 81 in the present embodiment is configured such that, as viewed in plane, three chuck claws 83 disposed at three equal angular intervals simultaneously move along the chuck surface 82 by the same amount toward the center of the chuck 81. That is, the chuck 81 is configured as follows: when the first tip 11 is placed in such a manner that the center of its base portion 15 is positioned at the reference center axis C1 of the chuck 81, the three claws 83 radially clamp the outer circumferential surface of its base portion 15. In the present embodiment, as shown in FIG. 3, each of the chuck claws 83 has an inner surface (located on a side toward the reference center axis C1) inclined by an appropriate amount (5 degrees to 15 degrees) in such a manner as to approach the reference center axis C1 as the distance from the chuck surface 82 increases, so as to generate a component force that presses (pulls) the base portion 15 toward the chuck surface 82 when the claws 83 clamp the base portion 15. This prevents the first tip 11 from separating from the chuck surface 82 when the first tip 11 is chucked by the chuck 81. A conventionally known parts feeder, which serves as the first tip supply means, supplies the first tip 11 such that its base portion 15 is disposed on the chuck surface 82 at the center of the chuck 81 in opened condition at the first position P1.

Figure 4:
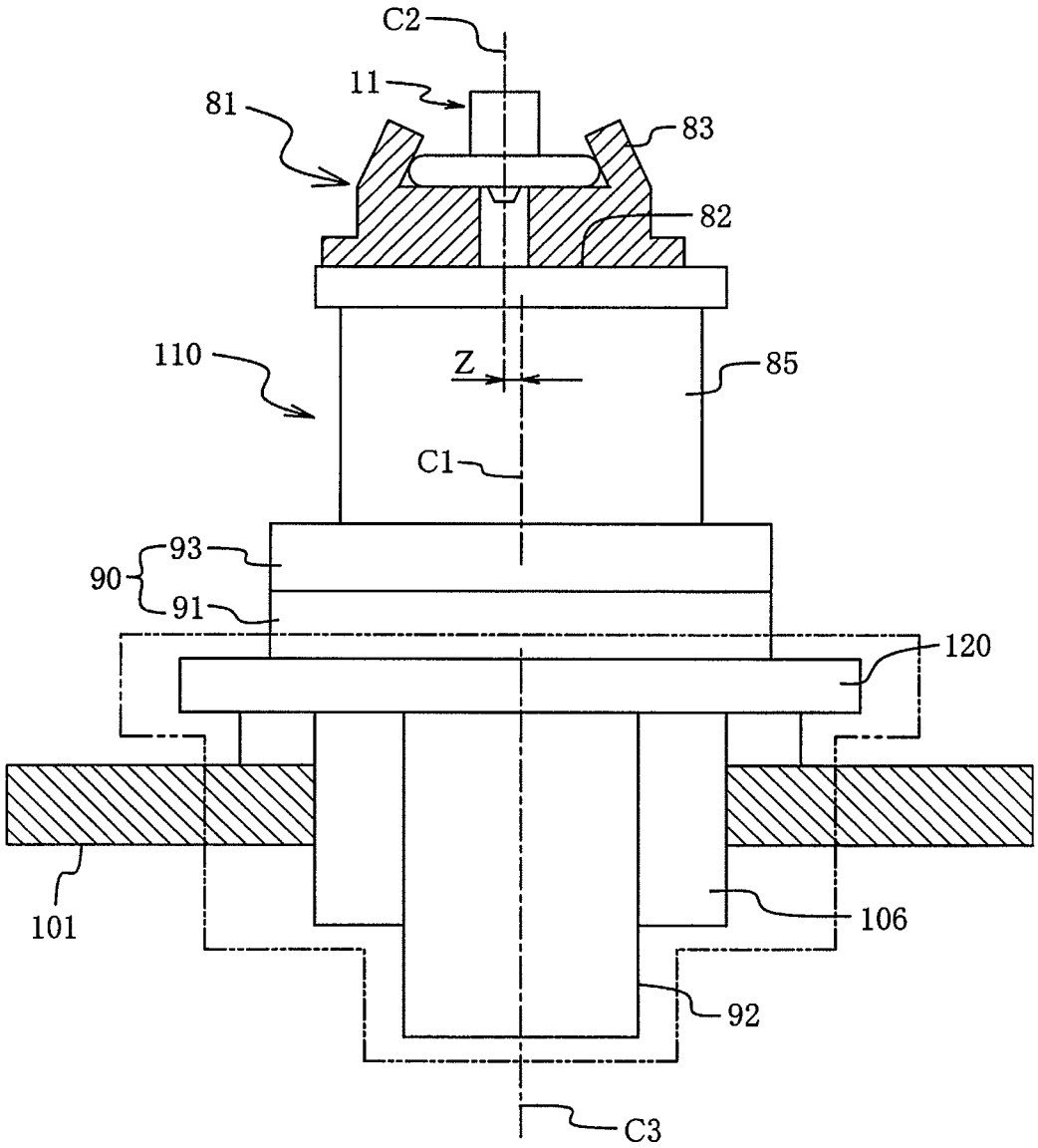
FIG. 4 is a view for explaining an eccentric error Z involved when a first tip, which corresponds to a first electrode member, is fixed by a chuck in FIG. 3.

As shown in FIG. 4, the first tip 11 chucked at the first position P1 through execution of the above-mentioned first tip holding step involves a positional deviation such that because of a very small difference in advancing speed and stroke among the claws 83, the actual center axis C2 of the first tip 11 deviates by a very small positional deviation (eccentric error) Z from the reference center axis C1 of the chuck 81 or the axis C3 of the shaft 92, and, as mentioned above, the eccentricity is about 0.025 mm on one side.

Figure 5:
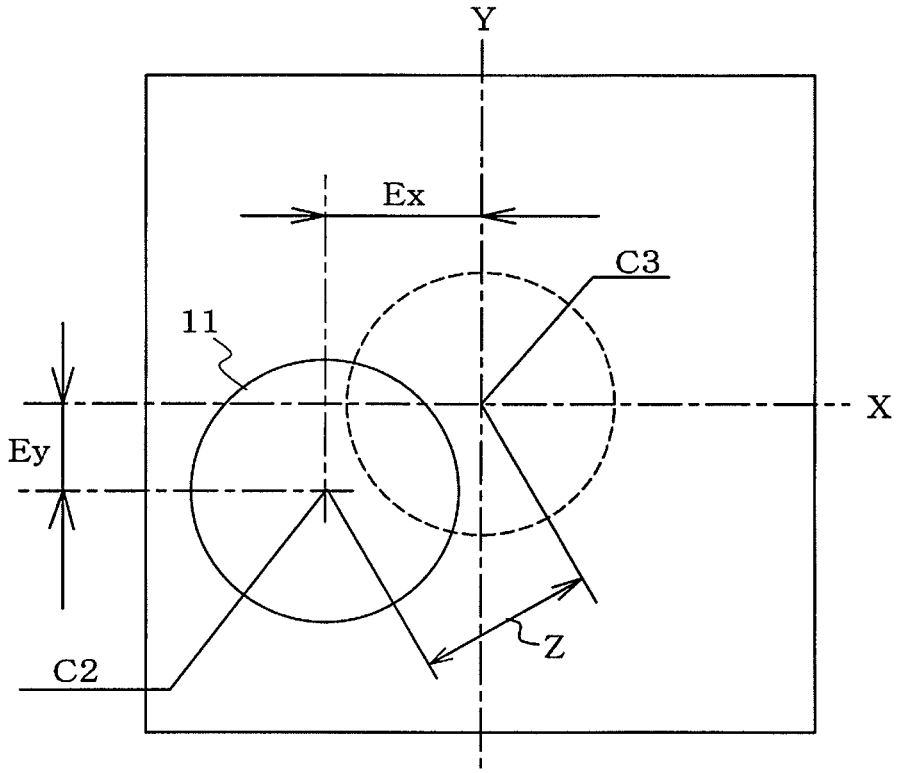
FIG. 5 is a conceptual view for explaining measurement of eccentric error.

Next, after the first tip 11 is chucked at the start position as mentioned above, the circular table 101 is rotated by 60 degrees and then stopped. By this operation, the chuck unit 110 in a state of chucking the first tip 11 is moved to the second position and then stopped there. In the present embodiment, at the stop position (second position) P2, the first tip 11 held by the chuck 81 is measured for the position of its actual center axis C2 by image processing. As shown in FIG. 5, there are detected eccentricities in the X and Y directions (eccentric errors Ex and Ey) between the position of the actual center axis C2 of the first tip 11 and a preset position (regular reference position) where the center axis of the first tip 11 is expected to be situated at the stop position. In the present embodiment, since the reference position is also the position of the shaft 92 of the chuck unit 110, there is detected the eccentric error Z in plane of the position of the actual center axis C2 of the first tip 11 with respect to the position of the axis C3 of the shaft 92.

Figure 6:
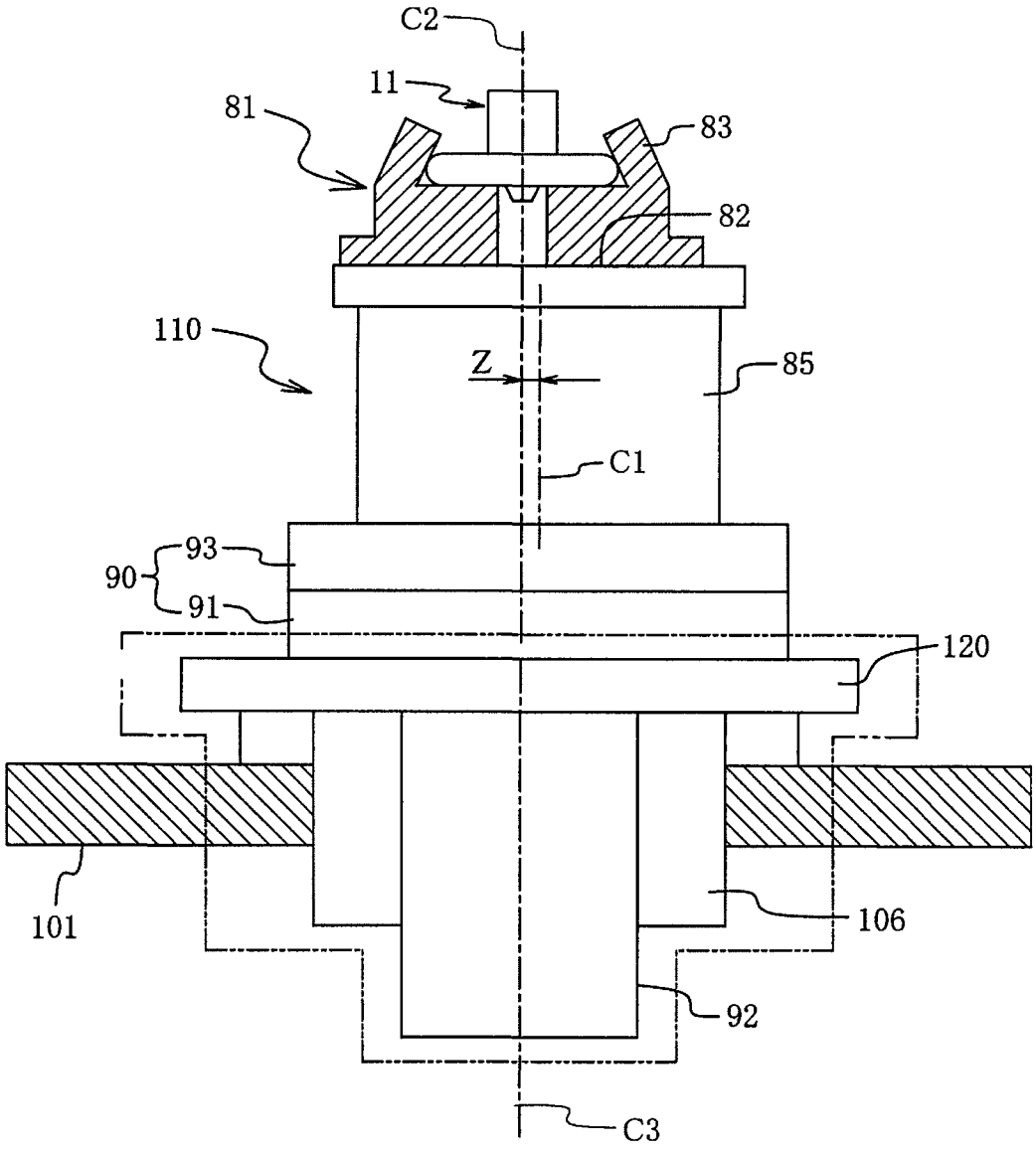
FIG. 6 is an explanatory view showing a condition after an actual center axis C2 of the first tip, which corresponds to the first electrode member, shown in FIG. 4 is positionally corrected by driving a chuck position adjustment means so as to be aligned with an axis C3 of a shaft.

In an eccentric error detection step at the second position P2, when the eccentric error Z falls outside a tolerance range, the above-mentioned chuck position adjustment means 90 is driven so as to correct the planar position of the chuck 81 for aligning the position of the actual center axis C2 of the first tip 11 with the position of the axis C3 of the shaft 92 as shown in FIG. 6. In the present embodiment, this center axis position correction step for the first tip is performed as follows: the above-mentioned lateral and longitudinal slide members 91 and 93, which constitute the chuck position adjustment means 90, are slidingly driven by predetermined amounts in the X and Y directions, respectively, so as to align the position of the actual center axis C2 of the first tip 11 with the position of the axis C3 of the shaft 92. Notably, even after such alignment, there still exists the eccentric error Z of the actual center axis C2 of the first tip 11 with respect to the reference center axis C1 of the chuck 81.

Measurement of the position of the actual center axis C2 of the first tip 11, etc.; i.e., the eccentric error detection step and the center axis position correction step for the first tip may be performed as follows. For example, the distal end surface (the distal end surface of the circular columnar portion) 13 of the first tip 11 is image-captured by a camera; the captured image is displayed on a monitor; and the position of the center (or the outer circumferential edge) C2 of the distal end surface (the distal end surface of the circular columnar portion) 13 of the first tip 11 is measured by image processing. On the basis of the result of the measurement, there are detected positional errors (Ex and Ey) of the center axis C2 in plane in the X and Y directions (error detection) with respect to a preset regular reference position (the position of the axis C3 of the shaft 92) where the center axis C2 is expected to be situated at the second position P2 (the eccentric error detection step for the first tip (the first electrode member)). When the eccentric error Z obtained on the basis of the detected amounts (errors) falls outside the tolerance range, the chuck position adjustment means 90 is driven so as to slide the slide members 91 and 93 by predetermined amounts in the X and Y directions, respectively, for fine adjustment (the center axis position correction step for the first tip (the first electrode member)). In this manner, as shown in FIG. 6, the center axis C2 of the actual distal end surface (the distal end surface of the circular columnar portion) of the first tip 11 is aligned with the position of the center C3 of the shaft 92 where the center axis C2 is expected to be situated at the stop position. In the present embodiment, a system is programmed so as to perform such fine adjustment on the basis of the above-mentioned result of measurement under computer control. The camera and the chuck position adjustment means 90 are sequentially operated in response to a signal indicative of arrival of the chuck unit 110 at the second position P2 and are reset in response to an action of the chuck unit 110 of leaving the second position P2 after its position is corrected by the chuck position adjustment means 90. After the position of the chuck 81 is adjusted by the chuck position adjustment means 90, for example, the slide members 91 and 93 are mechanically locked by a lock mechanism.

Figure 7:
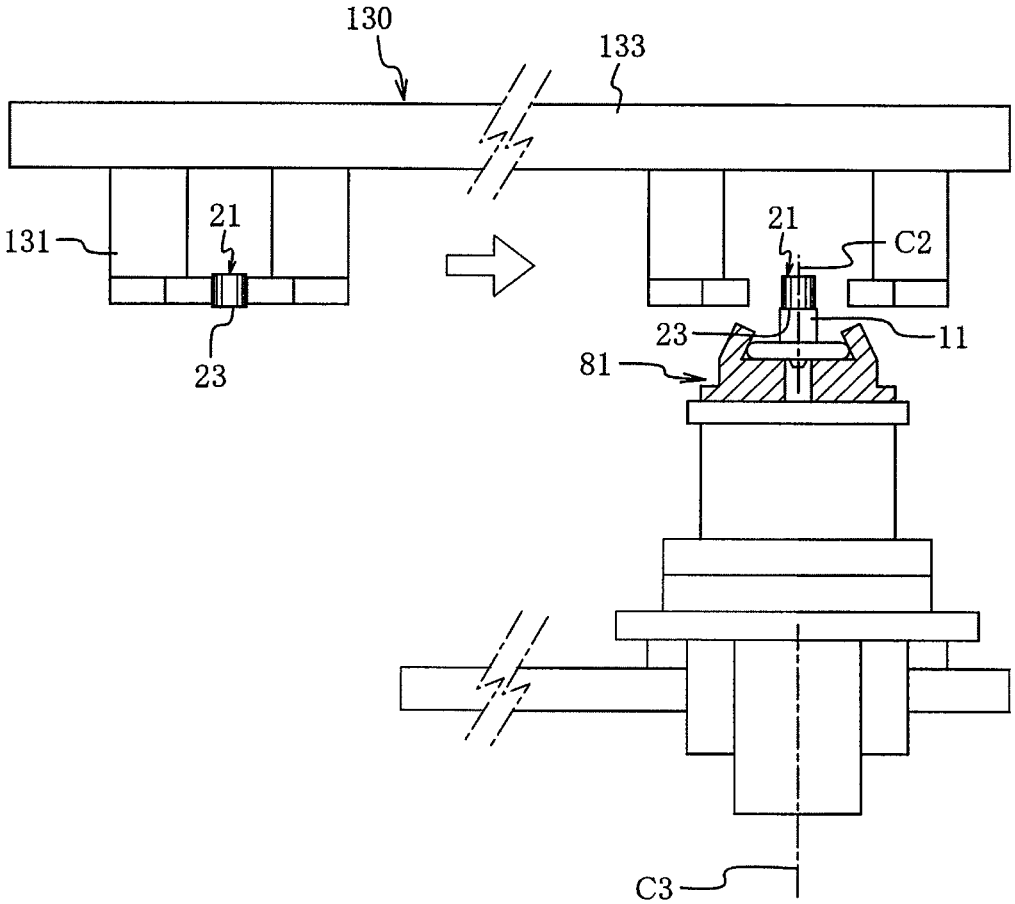
FIG. 7 is a view for explaining an operation of supplying a second tip, which corresponds to a second electrode member, to the first tip, which corresponds to the first electrode member, shown in FIG. 6 and then positioning and disposing the second tip on the first tip.

Next, after the position of the first tip 11 is corrected at the second position P2, the circular table 101 is rotated by 60 degrees and then stopped. By this operation, while being held in the condition of FIG. 6 in which the actual center axis C2 of the first tip 11 is positionally corrected so as to be aligned with the axis C3 of the shaft 92, the chuck unit 110 is moved to a third position P3. In the present embodiment, at the third position P3, there are performed supply of the second tip (Pt tip) 21 (hereinafter, may be referred to as the second tip supply step), which corresponds to the second electrode member supply step, and temporary welding of the second tip 21 (the temporary welding step). Specifically, the second tip 21 is gripped at its outer circumferential surface by, for example, conventionally known supply means 130 including handling means 131 and transport means 133 as shown in FIG. 7. Then, while the second tip 21 is gripped, its one end surface 23 is positioned and placed on the distal end surface of the small-diameter circular columnar portion of the first tip 11 situated at the third position P3. In this supply and displacement, a problem is positional alignment of the second tip 21 with the first tip 11. In this regard, the position of the first tip 11 is corrected such that the center axis C2 of the first tip 11 is aligned with the axis C3 of the shaft 92 of the chuck unit 110. Therefore, an only problem is moving accuracy in aligning the center C2 of the second tip 21 with the axis (center) C3 of the shaft 92. Since the second tip 21 is moved by the supply means 130 which uses a servomechanism, etc., and thus can be disposed with involvement of almost no error. Specifically, with a high accuracy in several μm to 10 μm units, the supply and displacement of the second tip 21 does not involve the occurrence of a problematic error.

Therefore, after, as mentioned above, the second tip 21 is supplied to the first tip 11 and then positioned and disposed such that the end surfaces of the first and second tips 11 and 21 are in contact with each other, at the third position P3, while the distal end surface of the second tip 21 is pressed with a press pin, the outer circumferential edges of the end surfaces 13 and 23 through which the first and second tips 11 and 21 are in contact with each other may be circumferentially laser-welded. In this regard, the present embodiment involves a temporary welding step of temporarily welding the outer circumferential edges at a spot through radiation of one pulse of laser beam (see FIG. 8). In the present embodiment, at the third position P3, in addition to the supply means 130 for the second tip 21, which corresponds to the second electrode member, as shown in FIG. 7 and unillustrated pressing means (press pin) for the second tip 21, a laser welding apparatus 201 for temporary welding is disposed (see FIG. 1). The press pin rises after temporary welding. Before temporary welding is performed as mentioned above, preferably, the position of the second tip 21 is confirmed from two or more directions by image processing or the like.

In the present embodiment, after the temporary welding step is performed, the circular table 101 is rotated by 60 degrees and then stopped; by this operation, the chuck unit 110 in which the chuck 81 chucks the first chip 11 to which the second tip 21 is temporarily welded is moved to a fourth position P4 in FIG. 1. At the fourth position, the first and second tips 11 and 21 undergo regular welding. Specifically, at the fourth position P4, the first tip 11 and the second tip 21 are laser-welded together by circumferentially laser-welding the outer circumferential edges of the joining surfaces of the first and second tips 11 and 21. In this laser welding (regular welding), the shaft 92 provided at the bottom of the base 120 which supports the chuck position adjustment means 90 of the chuck unit 110 is rotated substantially by one revolution in relation to the circular table 101 via unillustrated chuck unit 110 rotational-drive means. In the course of this revolution, a laser welding apparatus 301 disposed in the vicinity of the fourth position P4 performs pulse laser welding an appropriate number of times (e.g., eight times). By this procedure, as shown in FIG. 10B, the composite tip 31 in which the second tip 21 is laser-welded to the first tip 11 is yielded.

Figure 8:
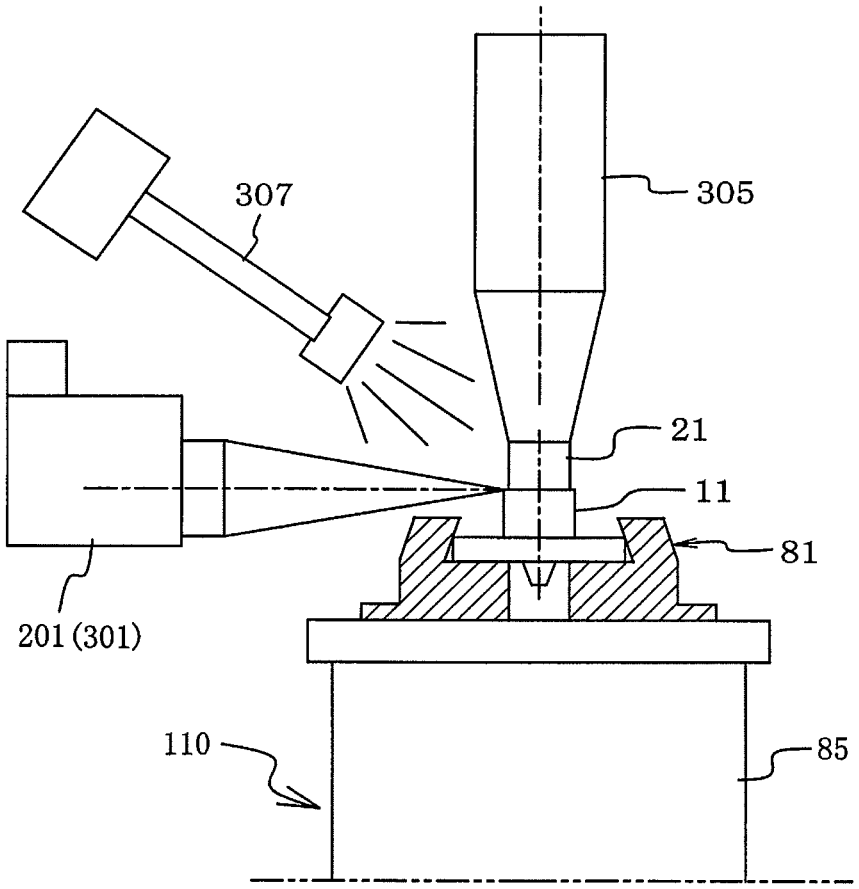
FIG. 8 is an explanatory view for laser welding.

Although the center of rotation of the chuck unit 110 in the course of this laser welding is the axis C3 (center) of the shaft 92, as a result of the above-mentioned positional correction, the actual center axis C2 of the first tip 11 is aligned with the center of the shaft 92, i.e., the axis C3 of the shaft. Furthermore, the second tip 21 maintains high concentricity with the first tip 11. Therefore, even though the laser welding apparatus 301 is fixed, laser radiation distance is free of deviation. In such regular welding, as shown in FIG. 8, it is good practice to perform welding while the second tip 21 is pressed with a second press pin 305. Preferably, the second press pin 305 is provided in such a manner as to rotate synchronously with the rotation of the chuck unit 110 or to freely undergo synchronous rotation via a thrust bearing. For regular welding, the following practice is recommended: the laser welding apparatus 301 has correction means for correcting the laser radiation position (height); the height of the joining surfaces of the first and second tips 11 and 21 is detected with a sensor; and the laser radiation position is automatically adjusted. This is because a very small dimensional tolerance is also assigned for the height of the first tip 11. Also, for regular welding, the following practice is recommended: as shown in FIG. 8, for example, argon gas blowing means 307 is provided for blowing argon gas toward a weld zone, and in the course of welding, argon gas is blown to prevent adhesion of welding spatters to the surface of the composite tip 31.

As mentioned above, regular welding is performed at the fourth position P4, thereby manufacturing the composite tip 31. In the present embodiment, subsequently, the circular table 101 is rotated by 60 degrees and then stopped at a fifth position P5. At the fifth position P5, the composite tip 31 undergoes appearance inspection effected by image inspection processing in order to inspect its surface including the weld zone for adhesion of welding spatters and existence of welding sag. Also, in this inspection, similar to the practice at the fourth position P4, the shaft 92 of the chuck unit 110 may be rotated for appearance inspection of the composite tip 31. In the inspection, through rotation of the composite tip 31, welding spatters and welding sag can be readily detected as protrusions (convexes).

In the present embodiment, after the image inspection processing, the circular table 101 is rotated by 60 degrees to send the chuck unit 110 to an eject position at a sixth position P6. At the sixth position P6, the chuck 81 is opened to eject the composite tip 31 which has undergone regular welding, whereby the welded composite tip 31 is delivered. Preferably, in ejection, the composite tips 31 are ejected while being classified according to acceptance and rejection on the basis of judgment of acceptance and rejection (non-defective and defective) in the appearance inspection at the position P5. The chuck unit 110 which has released the composite tip 31 is sent to the start position of the process; i.e., the first position P1, by rotating the circular table 101 by 60 degrees. Notably, it is good practice for the chuck unit 110 to be reset again after the appearance inspection and before transmission to the start position such that the reference center axis C1 of the chuck 81 is aligned with the shaft 92 of the chuck unit 110 by driving the chuck position adjustment means 90. Subsequently, the above-mentioned steps which start from supply of the first tip 11 are repeated, thereby manufacturing the composite tips 31, which correspond to the electrode composites, one after another.

As mentioned above, according to the manufacturing method of the present embodiment, after the first tip 11, which corresponds to the first electrode member, is held by the chuck 81, even though the actual center axis C2 of the first tip 11 is eccentric in excess of tolerance to the reference center axis C1 of the chuck 81 and to the axis of the shaft 92, at the second position P2, before the second tip 21, which corresponds to the second electrode member, is supplied and then positioned and disposed, the position of the first tip 11 is corrected so as to be aligned with the position of the shaft 92. That is, the manufacturing method has the eccentric error detection step which comes after the first tip holding step (first electrode member holding step) and before the second tip supply step (second electrode member supply step). The eccentric error detection step is adapted to detect an eccentric error between the position of the actual center axis C2 of the first tip 11 and the shaft 92 of the base 120 rotatably supporting the chuck 81 of the chuck unit. When the eccentric error detected by the eccentric error detection step falls outside the tolerance range subsequent to the eccentric error detection step, the center axis position correction step corrects the position of the actual center axis C2 of the first tip so as to align the actual center axis C2 of the first tip with the axis C3 of the shaft 92 of the base 120. Thus, at the subsequent third position P3, when the second tip 21 is supplied to the positioned first tip 11, the first and second tips 11 and 21 can be disposed concentric with the shaft 92 with high coaxiality. Therefore, subsequently, when the first and second tips 11 and 21 are welded, while the chuck unit 110 is rotated about the axis C3 of the shaft 92, the composite tip 31 having high coaxiality can be efficiently yielded.

That is, the above-mentioned manufacturing method does not employ the following aligning method: after the second tip 21, which corresponds to the second electrode member, is supplied and then positioned and disposed on the first tip 11, which corresponds to the first electrode member, held by the chuck 81 (after the second tip 21 supply step), coaxiality between the first and second tips 11 and 21 is measured, and if the measured coaxiality involves an error which falls outside tolerance, the coaxiality (eccentric error) of the second tip 21 with respect to the first tip 11 is adjusted. Therefore, according to the present invention, the joining surfaces (the end surfaces of the first and second tips in contact with each other) 13 and 23 do not rub each other and thus are free from scratching.

Furthermore, in the present embodiment, as described above, the six chuck units 110 are provided on the circular table 101 in such a manner as to be disposed at equal angular intervals on the imaginary circle 103 whose center is concentric with the rotational center 100 of the circular table 101; at the positions P1 to P6 located at 60-degree intervals, there are performed the step of supplying the first tip 11, which corresponds to the first electrode member, to the chuck 81 and holding the first tip 11 by the chuck 81, the eccentric error detection step and the center axis position correction step for the first tip 11, the step of supplying the second tip 21, which corresponds to the second electrode member, and the temporary welding step, the regular welding step, the image inspection step, and the step of ejecting the welded composite tip 31; by this procedure, while the circular table 101 is rotated by one revolution, the composite tip is manufactured and then ejected. That is, since these steps are carried out at the corresponding stop positions, residence time at the individual stop positions is reduced; therefore, efficiency in manufacturing the composite tip 31, which corresponds to the electrode composite, can be markedly enhanced.

In the above-described embodiment, detecting the position of the first tip 11 (eccentric error detection step), which corresponds to the first electrode member, and correcting the position (center axis position correction step) are performed at the same position (second position P2) in the course of rotation (in the course of revolution) of the circular table 101. However, these steps may be performed at different positions in the course of revolution, so long as the steps are performed before supply of the second tip 21, which corresponds to the second electrode member. Therefore, in the above-described embodiment, the detecting step and the correcting step may be performed as follows: after detection of an eccentric error between the position of the actual center axis C2 of the first tip 11, which corresponds to the first electrode member, and the axis C3 of the shaft 92 of the chuck unit 110 (after the eccentric error detection step), the circular table 101 is rotated again so as to move the chuck unit 110 by a predetermined amount, and then stopped. Then, at the different stop position after the detection step, if the eccentric error falls outside the tolerance range, the position of the chuck 81 is corrected (center axis position correction step) as mentioned above; i.e., the position of the actual center axis C2 of the first tip 11, which corresponds to the first electrode member, is aligned with the position of the shaft 92. In this manner, this positional correction (center axis position correction step) may be performed at a different position, so long as the correction step is performed before the second tip supply step, which corresponds to the second electrode member supply step.

Also, the above embodiment is described while mentioning the case where the steps are performed at the six positions. However, revolution may be stopped at 45-degree intervals so as to perform the steps at eight positions as follows: five of the above-mentioned steps; i.e., the step of supplying the first tip 11 to the chuck 81 (first electrode member holding step), the eccentric error detection step for the first tip 11, the center axis position correction step for the first tip 11, the second tip supply step (second electrode member supply step), and the temporary welding step, are separately performed at the first to fifth positions, and the remaining three steps; i.e., the regular welding step, the appearance inspection step, and the ejection step, are performed at the sixth to eighth positions. The appearance inspection step may be performed after the ejection step of ejecting the composite tip from the regular welding step, and ejection and regular welding may be performed at the same position.

Furthermore, the above embodiment is described while mentioning the case where, before the outer circumferential edges of the end surfaces of the first and second tips, which correspond to the first and second electrode members, are laser-welded (undergo regular welding), temporary welding is performed at the preceding step (second electrode member supply step); subsequently, at the advanced position P4, regular welding is performed. However, without performing such temporary welding, at the fourth position P4 in the above-mentioned embodiment, temporary welding and regular welding may be performed simultaneously, or regular welding may be directly performed. Furthermore, regular welding can be performed by use of, for example, two laser welding apparatus. In such a case, the chuck unit 110 can be rotated about the shaft 92 half a revolution or less.

The present invention is not limited to the above embodiment, but may be embodied in an appropriately modified form without departing from the gist of the invention. For example, the revolvingly moving means for the chuck units is described while mentioning a rotary table. However, the revolvingly moving means is not limited thereto. In the case where the electrode composite to be manufactured is the above-mentioned composite tip, the electrode composite may be adapted to form the center electrode or the ground electrode of the spark plug. By configuring a center electrode 71 or a ground electrode 61 of the spark plug 41 shown in FIG. 11 by use of the thus-manufactured composite tip 31, a high-performance spark plug can be yielded. That is, for example, the ground electrode is formed by welding the composite tip 31, which corresponds to the electrode composite, to a ground electrode body 60 via the first tip 11 of the composite tip 31 such that the second tip of the composite tip 31 is located on a side toward the spark gap.

Figure 9:
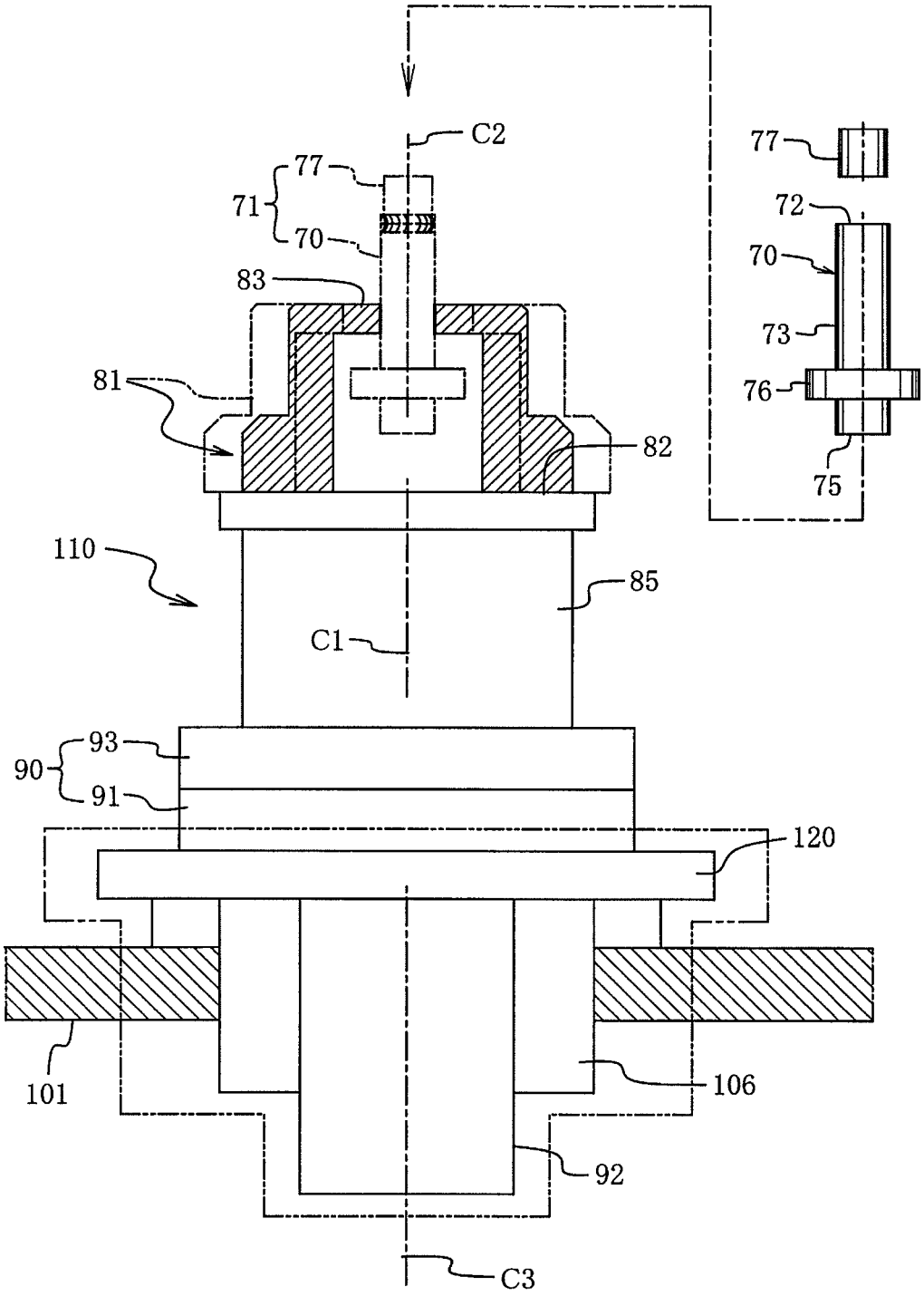
FIG. 9 is an enlarged elevational view for explaining a chuck unit in the case where an electrode composite to be manufactured in FIG. 3 is a center electrode.

The above embodiment is described while mentioning the composite tip 31 shown in FIG. 10B as the electrode composite to be manufactured. However, as is apparent from the above description, the electrode composite to be manufactured in the present invention is not limited to the composite tip 31. That is, the electrode composite may be the entire center electrode 71 of the spark plug 41 shown in FIG. 11 such that the first electrode member is a center electrode body 70 and such that the second electrode member is an electrode tip 77 welded to the forward end of the center electrode body 70. This is for the following reason: even in manufacture of such a center electrode 71, the above-mentioned method can be applied; specifically, as shown in FIG. 9, by use of an apparatus similar to that mentioned above and the chuck unit 110, the center electrode body 70, which is a stem member, is chucked; the electrode tip (which corresponds to the noble metal tip in the above-described embodiment) 77 is supplied and then positioned and disposed on a forward end 72 of the center electrode body 70; and steps similar to those mentioned above are carried out.

That is, in the case where the electrode composite is the center electrode 71 as mentioned above, as shown in FIG. 9, the manufacturing apparatus mentioned in the description of the above embodiment may be modified such that the chuck 81 of the chuck unit 110 and the claws 83 of the chuck 81 have shapes and structures capable of appropriately holding the center electrode body 70, which corresponds to the first electrode member, shown in FIG. 9. The manufacturing apparatus is also modified to allow the following: after the center electrode body 70 is held by the claws 83 of the chuck 81, the electrode tip 77, which corresponds to the second electrode member, is supplied and disposed such that its end surface is concentrically in contact with the end surface (forward end surface) 72 of the center electrode body 70. In this manner, the first and second electrode members of the electrode composite differ from those of the composite tip in the above embodiment; however, apparently, similar effects are yielded by undergoing steps similar to those in the above embodiment.

In the case where the electrode composite is the center electrode 71, the center electrode body 70, which corresponds to the first electrode member, of the center electrode 71 is relatively thick and long in contrast to the first tip 11 in the above embodiment. Specifically, the center electrode body 70 has, for example, as shown in FIG. 9, a circular stem (a circular stem of a fixed diameter) 73 as a base body, and a circular flange 76, which is located toward a rear end (a lower end in FIG. 9) 75 of the circular stem 73, is coaxial with the circular stem 73, and projects outwardly from the circular stem 73. In such a case, as shown in FIG. 9, the chuck 81 may be configured as follows: when driven, the chuck 81 can hold the center electrode body 70 at an intermediate portion (outer circumferential surface) of the circular stem 73 located forward of the circular flange 76. The chuck 81 in FIG. 9 is formed such that its claws 83 can accommodate a rear-end portion, including the circular flange 76, of the circular stem 73 of the center electrode body 70. In FIG. 9, the electrode tip 77, which corresponds to the second electrode member, assumes the form of a circular columnar member having an outside diameter slightly smaller than that of the forward end 72 of the center electrode body 70, which corresponds to the first electrode member. Thus, after the electrode tip 77 is supplied and disposed such that its end surface comes into coaxial (concentric) contact with the forward end (forward end surface) 72 of the center electrode body 70, the electrode tip 77 is welded along the outer circumference of its joining surface.

In the above embodiments, the electrode composites to be manufactured are the composite tip and the center electrode. However, the electrode composite of the present invention is not limited thereto, but can be widely applied to electrode composites for forming electrodes of spark plugs. That is, the electrode composite according to the present invention can be widely applied to electrode composites for forming electrodes of spark plugs, the electrode composites each being formed by laser-welding the first electrode member and the second electrode member. This is for the following reason: in manufacture of these electrode composites, by use of an apparatus similar to that mentioned above, the first electrode member is chucked; the second electrode member is supplied and then positioned and disposed on the end of the chucked first electrode member; and steps similar to those mentioned above are carried out; therefore, effects similar to those mentioned above are yielded by undergoing steps similar to those mentioned above. The electrode composite may be a component member of the center electrode, for example, a portion of the center electrode rather than the entire center electrode. In this case, by welding the first electrode member and the second electrode member, the portion of the center electrode (e.g., a portion, including the forward end, of the center electrode rather than the entire center electrode) is formed.

Embodiments 1 to 3 of the invention of a method of manufacturing an electrode composite are disclosed below. In embodiments 1 to 3, the electrode composite to be manufactured is the composite tip; the first electrode member is the first tip (tip body); and the second electrode member is the second tip (noble metal tip). However, even in embodiments 1 to 3, the electrode composite can be applied to the center electrode, etc., so long as the electrode composite is adapted to form an electrode of a spark plug. That is, in embodiments 1 to 3, the composite tip can be replaced with the electrode composite (e.g., the center electrode); the first tip can be replaced with the first electrode member (e.g., the center electrode body); and the second tip can be replaced with the second electrode member (e.g., an electrode tip in the form of a noble metal tip).

Embodiment 1

In accordance with a first embodiment of the present invention, there is provided a method of manufacturing a composite tip for forming an electrode of a spark plug, the composite tip being formed by welding a first tip corresponding to a tip body, and a second tip corresponding to a noble metal tip, the method comprising a step of positioning such that end surfaces of the first and second tips come into contact with each other, and a laser welding step of welding outer circumferential edges of the end surfaces through which the first tip and the second tip are in contact with each other, the method being characterized in that:

a manufacturing apparatus used in the method has a plurality of chuck units, each including a chuck having a plurality of chuck claws capable of holding the first tip, chuck position adjustment means capable of adjusting the position of a reference center axis of the chuck, and a pedestal for supporting the chuck position adjustment means, and the pedestal of each of the chuck units has a shaft being coaxial with the reference center axis of the chuck or being able to be coaxial with the reference center axis of the chuck through adjustment by the chuck position adjustment means;

the chuck units are disposed via the shafts on a revolvingly moving means at predetermined positions, the revolvingly moving means revolving on a predetermined path and being controlled so as to stop at least at positions where the steps are performed, and the chuck units are configured to be rotatable about the axes of the shafts at least at a position where the laser welding step is performed;

after the revolvingly moving means is driven, the first tip is supplied to and held by the chuck of the chuck unit situated at a process start position; subsequently, the revolvingly moving means is driven to move, by a predetermined amount, the chuck unit which holds the first tip, and then to stop the chuck unit;

at the stop position, the position of the actual center axis of the first tip held by the chuck is measured by image processing, and an eccentric error is detected between the position of the actual center axis of the first tip and the shaft of the chuck unit;

when the eccentric error falls outside a tolerance range, the chuck position adjustment means is driven to correct the position of the chuck for aligning the position of the actual center axis of the first tip with the position of the shaft; subsequently, the revolvingly moving means is driven to move the chuck unit by a predetermined amount and then to stop the chuck unit;

at the stop position, the second tip is supplied and positioned such that the end surfaces of the first and second tips come into contact with each other; and subsequently, while the chuck unit in which the second tip is positioned and disposed on the first tip is rotated about the axis of the shaft, the outer circumferential edges of the end surfaces through which the first tip and the second tip are in contact with each other are laser-welded.

Embodiment 2

In accordance with a second embodiment of the present invention, there is provided a method of manufacturing a composite tip for forming an electrode of a spark plug as described above with respect to embodiment 1, further characterized in that, in place of the following limitation:

"the position of the actual center axis of the first tip held by the chuck is measured by image processing, and an eccentric error is detected between the position of the actual center axis of the first tip and the shaft of the chuck unit;

when the eccentric error falls outside a tolerance range, the chuck position adjustment means is driven to correct the position of the chuck for aligning the position of the actual center axis of the first tip with the position of the shaft; subsequently, the revolvingly moving means is driven to move the chuck unit by a predetermined amount and then to stop the chuck unit;"

the position of the actual center axis of the first tip held by the chuck is measured by image processing, and an eccentric error is detected between the position of the actual center axis of the first tip and the shaft of the chuck unit, and subsequently, the revolvingly moving means is driven to move the chuck unit by a predetermined amount and then to stop the chuck unit, and at the stop position, when the eccentric error falls outside the tolerance range, the chuck position adjustment means is driven to correct the position of the chuck for aligning the position of the actual center axis of the first tip with the position of the shaft; subsequently, the revolvingly moving means is driven to move the chuck unit by a predetermined amount and then to stop the chuck unit.

Embodiment 3

In accordance with a third embodiment of the present invention, there is provided a method of manufacturing a composite tip for forming an electrode of a spark plug as described in embodiments 1 or 2, further characterized in that, in place of "the second tip is supplied and positioned such that the end surfaces of the first and second tips come into contact with each other; and subsequently, while the chuck unit in which the second tip is positioned and disposed on the first tip is rotated about the axis of the shaft, the outer circumferential edges of the end surfaces through which the first tip and the second tip are in contact with each other are laser-welded,"

the second tip is supplied and positioned such that the end surfaces of the first and second tips come into contact with each other;

subsequently, the outer circumferential edges of the end surfaces through which the first tip and the second tip are in contact with each other are temporarily welded by laser welding; subsequently, the revolvingly moving means is driven to move the chuck unit by a predetermined amount and then to stop the chuck unit; and at the stop position, while the chuck unit is rotated about the axis of the shaft, the outer circumferential edges of the end surfaces through which the first tip and the second tip are in contact with each other are laser-welded.

Embodiment 4

In accordance with a fourth embodiment of the present invention, there is provided a method of manufacturing a composite tip for forming an electrode of a spark plug according to any one of embodiments 1 to 3 mentioned above, further characterized in that the revolvingly moving means is configured to intermittently move the chuck units by predetermined amounts at equal angular intervals on and along a fixed circular path.

Having described the invention, the following is claimed:

1. A method of manufacturing an electrode composite for forming an electrode of a spark plug, the electrode composite being formed by laser-welding a first electrode member and a second electrode member together, the method comprising the steps of:

a first electrode member holding step of holding the first electrode member by a chuck of a chuck unit;

an eccentric error detection step to detect an eccentric error between a position of an actual center axis of the first electrode member and a shaft of a base rotatably supporting the chuck of the chuck unit;

a center axis position correction step of correcting the position of the actual center axis of the first electrode member when the eccentric error detected in the eccentric error detection step falls outside a tolerance range subsequent to the eccentric error detection step, said center axis position correcting step aligning the actual center axis of the first electrode member with an axis of the shaft of the base;

a second electrode member supply step of supplying the second electrode member such that an end surface of the second electrode member comes into contact with an end surface of the first electrode member; and a laser welding step of welding outer circumferential edges of the end surfaces through which the first electrode member and the second electrode member are in contact with each other.

2. A method of manufacturing an electrode composite for forming an electrode of a spark plug according to claim 1, further comprising a temporary welding step coming after the second electrode member supply step and before the laser welding step, said temporary welding step adapted to temporarily weld the outer circumferential edges of the end surfaces through which the first electrode member and the second electrode member are in contact with each other.

3. A method of manufacturing an electrode composite for forming an electrode of a spark plug according to claim 1 or 2, characterized in that:

a plurality of the chuck units are disposed on revolvingly moving means so as to sequentially move in association with revolution of the revolvingly moving means, and the eccentric error detection step and the center axis position correction step are performed at the same position in the course of revolution.

4. A method of manufacturing an electrode composite for forming an electrode of a spark plug according to claims 1 or 2, characterized in that:

a plurality of the chuck units are disposed on revolvingly moving means so as to sequentially move in association with revolution of the revolvingly moving means, and the first electrode member holding step and the eccentric error detection step are performed at different positions in the course of revolution.

5. A method of manufacturing a spark plug which has an insulator having an axial bore in a direction of an axis, a center electrode disposed in a forward end portion of the axial bore, a metallic shell circumferentially surrounding the insulator, and a ground electrode whose one end is joined to the metallic shell and whose other end faces a forward end of the center electrode, and in which the center electrode or the ground electrode is an electrode composite formed by joining a first electrode member and a second electrode member together, or has the electrode composite joined thereto, the method being characterized in that the electrode composite is manufactured by a manufacturing method according to claims 1 or 2.

* * * * *